US010128579B2

(12) United States Patent
Wu et al.

(10) Patent No.: US 10,128,579 B2
(45) Date of Patent: Nov. 13, 2018

(54) DIPOLE ANTENNA ELEMENT WITH OPEN-END TRACES

(71) Applicant: CommScope Technologies LLC, Hickory, NC (US)

(72) Inventors: Ligang Wu, Suzhou (CN); Bo Wu, Suzhou (CN); Fan Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 151 days.

(21) Appl. No.: 14/950,402

(22) Filed: Nov. 24, 2015

(65) Prior Publication Data

US 2016/0240933 A1 Aug. 18, 2016

Related U.S. Application Data

(60) Provisional application No. 62/116,332, filed on Feb. 13, 2015.

(51) Int. Cl.

| | |
|---|---|
| ***H01Q 21/26*** | (2006.01) |
| ***H01Q 1/24*** | (2006.01) |
| ***H01Q 1/38*** | (2006.01) |
| ***H01Q 5/40*** | (2015.01) |

(52) U.S. Cl.

CPC ..... *H01Q 21/26* (2013.01); *H01Q 1/246* (2013.01); *H01Q 1/38* (2013.01); *H01Q 5/40* (2015.01)

(58) Field of Classification Search

CPC ..... H01Q 21/30
USPC ..... 343/794
See application file for complete search history.

(56) References Cited

U.S. PATENT DOCUMENTS

| | | | |
|---|---|---|---|
| 2004/0222922 | A1 | 11/2004 | Kuo et al. |
| 2007/0120748 | A1 | 5/2007 | Jenwatanavet et al. |
| 2010/0045556 | A1 | 2/2010 | Wong et al. |
| 2012/0001818 | A1 | 1/2012 | Lee et al. |
| 2013/0082898 | A1 | 4/2013 | Asanuma et al. |
| 2014/0111396 | A1 | 4/2014 | Hyjazie et al. |

(Continued)

FOREIGN PATENT DOCUMENTS

| | | | |
|---|---|---|---|
| JP | H05145324 | A | 6/1993 |
| WO | WO 2011/091763 | A1 | 8/2011 |

OTHER PUBLICATIONS

International Search Report and Written Opinion Corresponding to International Application No. PCT/US2015/066843; dated Mar. 31, 2016; 11 Pages.

(Continued)

*Primary Examiner* — Andrea Lindgren Baltzell
(74) *Attorney, Agent, or Firm* — Myers Bigel, P.A.

(57) ABSTRACT

A first-band radiating element configured to operate in a first frequency band may be designed for reducing distortion associated with one or more second-band radiating element configured to operate in a second frequency band. The first-band radiating element may include a first printed circuit board. The first printed circuit board may include a first surface including a first feed line connected to a feed network of a feed board of an antenna. The radiating element may also include a second surface opposite the first surface. The second surface may include one or more first conductive planes connected to a ground plane of the feed board; and one or more first open-end traces coupled to the one or more conductive planes.

20 Claims, 11 Drawing Sheets

(56) References Cited

U.S. PATENT DOCUMENTS

2014/0139387 A1* 5/2014 Jones ..... H01Q 21/30
343/794

OTHER PUBLICATIONS

International Preliminary Report on Patentability and the Written Opinion of the International Searching Authority corresponding to International Patent Application No. PCT/US2015/066843 (dated Aug. 24, 2017) (7 pages).
Supplementary European Search Report corresponding to International Application No. EP 15 88 2270, dated Aug. 2, 2018, 9 pages.

* cited by examiner

DIPOLE ANTENNA ELEMENT WITH OPEN-END TRACES

CROSS REFERENCE TO RELATED APPLICATIONS

This application claims the benefit of U.S. Provisional Patent Application No. 62/116,332, filed on Feb. 13, 2015, the contents of which are incorporated herein by reference in their entirety.

BACKGROUND

Various aspects of the present disclosure may relate to base station antennas, and, more particularly, to dipole antenna elements of base station antennas.

Multi-band antennas for wireless voice and data communications are known. For example, common frequency bands for Global System for Mobile Communications (GSM) services may include GSM 900 and GSM 1800. A low band of frequencies in a multi-band antenna may include a GSM 900 band, which may operate in frequency range of 880-960 MHz. The low band may also include additional spectrum, e.g., in a frequency range of 790-862 MHz.

A high band of a multi-band antenna may include a GSM 1800 band, which may operate in a frequency range of 1710-1880 MHz. A high band may also include, for example, the Universal Mobile Telecommunications System (UMTS) band, which may operate in a frequency range of 1920-2170 MHz. Additional bands may comprise Long Term Evolution (LTE), which may operate in a frequency range of 2.5-2.7 GHz, and WiMax, which may operate in a frequency range of 3.4-3.8 GHz.

When a dipole element is employed as a radiating element, it may be common to design the dipole so that its first resonant frequency is in a desired frequency band. In multi-band antennas, radiation patterns for a higher frequency band may become distorted by resonances that develop in radiating patterns that are designed to radiate at a lower frequency band. Such resonances may affect the performance of high-band radiating elements and/or the low-band radiating elements of the multi-band antenna.

SUMMARY OF THE DISCLOSURE

Various aspects of the present disclosure may be directed to a first-band radiating element configured to operate in a first frequency band, for reducing distortion associated with one or more second-band radiating elements configured to operate in a second frequency band. The first-band radiating element may include a first printed circuit board. The first printed circuit board may include a first surface including a first feed line connected to a feed network of a feed board of an antenna. The radiating element may also include a second surface opposite the first surface. The second surface may include one or more first conductive planes connected to a ground plane of the feed board; and one or more first open-end traces coupled to the one or more conductive planes.

BRIEF DESCRIPTION OF THE SEVERAL VIEWS OF THE DRAWINGS

The following detailed description will be better understood when read in conjunction with the appended drawings. For the purpose of illustration, there are shown in the drawings, various embodiments. It should be understood, however, that the invention is not limited to the precise arrangements and instrumentalities shown.

In the drawings.

DETAILED DESCRIPTION OF VARIOUS EMBODIMENTS

Figure 1:
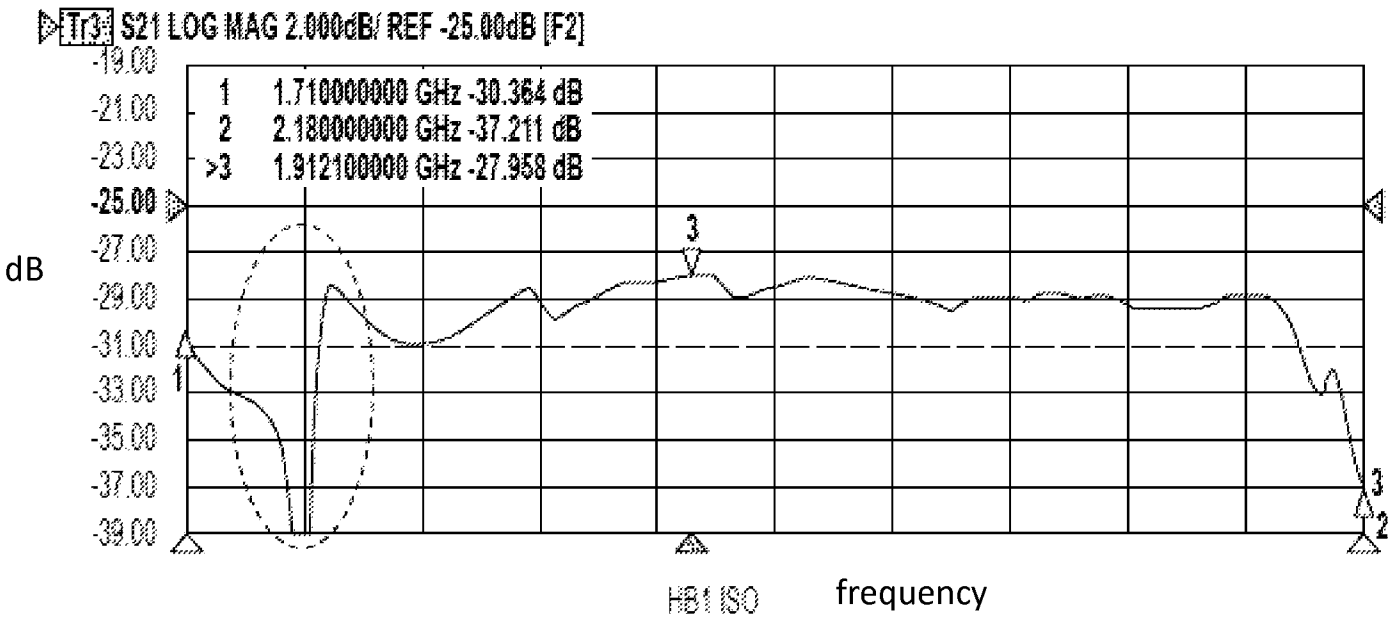
FIG. 1 is an isolation curve of two polarizations of one array of second-band radiating elements.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
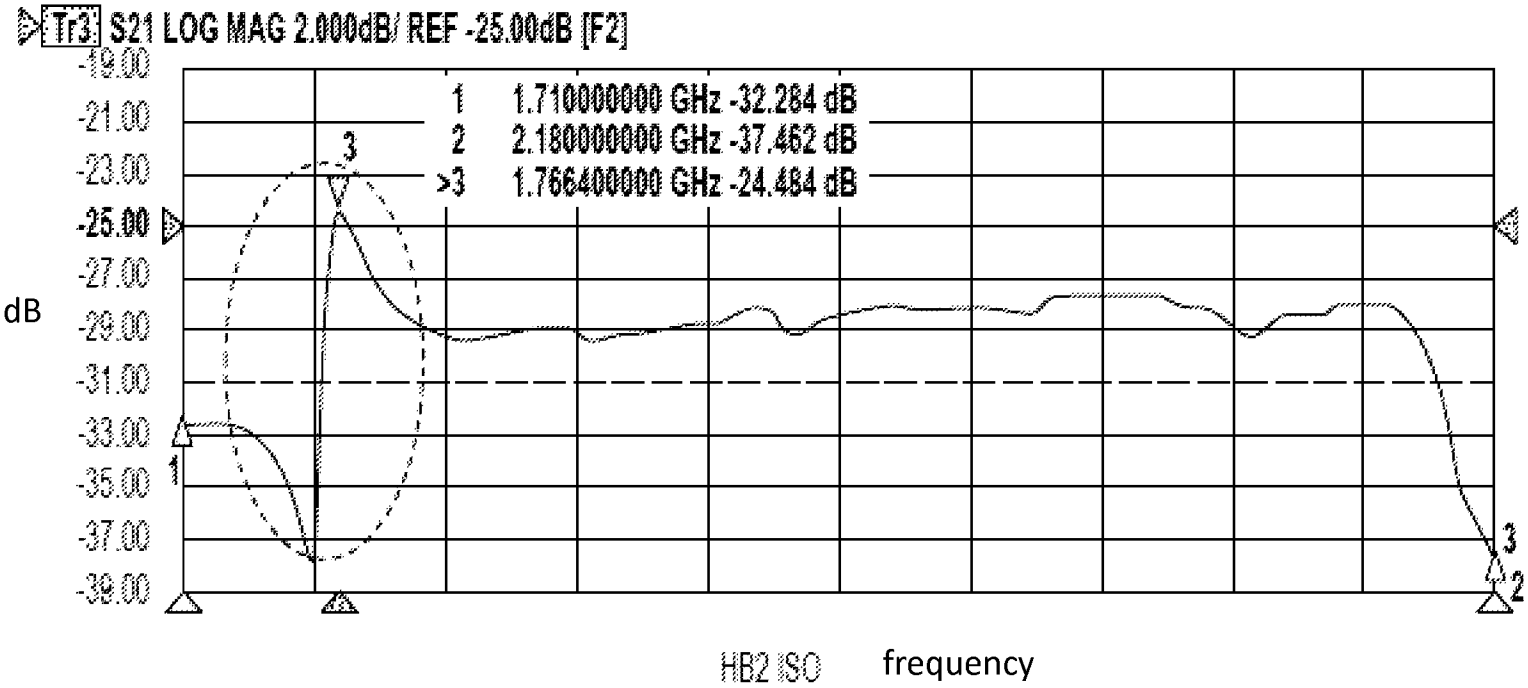
FIG. 2 is an isolation curve of another array of second-band radiating elements.
Figure 3:
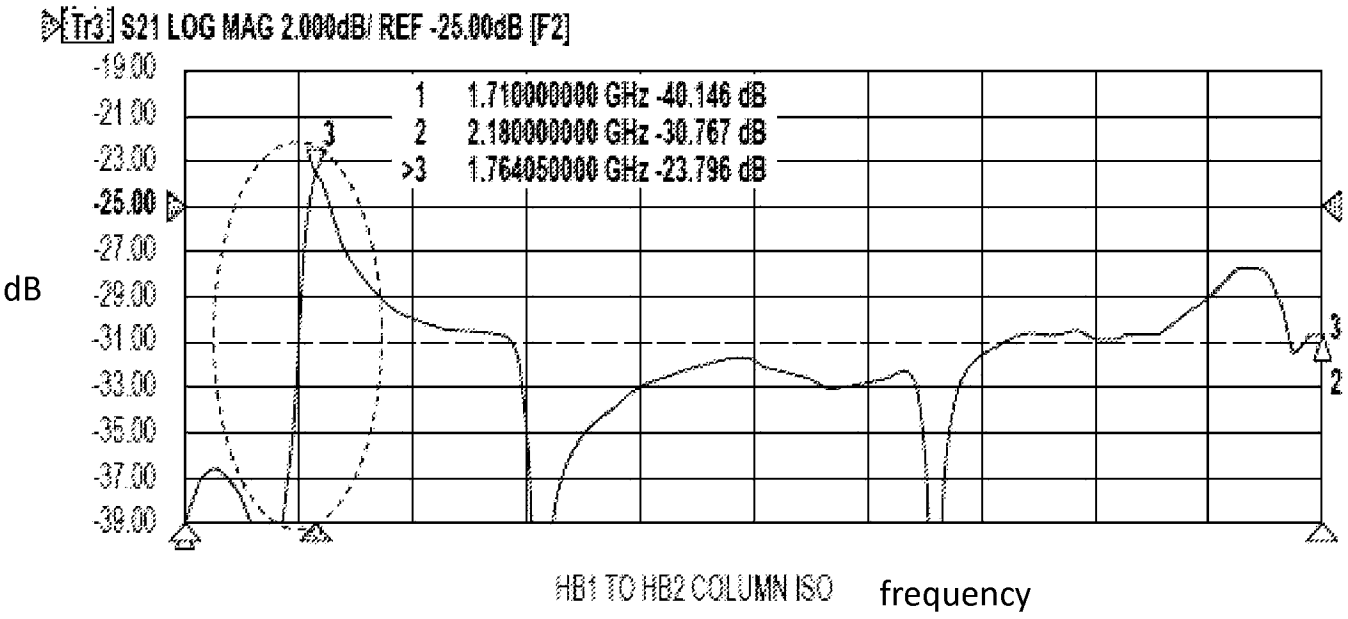
FIG. 3 is an isolation curve between arrays of second-band radiating elements.

As discussed above, there are often problems with resonance from first-band radiating elements (e.g., radiating elements configured to operate in a low frequency band) creating interference with second-band radiating elements (e.g., radiating elements configured to operate in a high frequency band). For example, FIGS. 1, 2, and 3 are isolation curves of two polarizations of an array of second-band radiating elements (e.g., a first array of high band elements), another array of second-band radiating elements (e.g., a second array of high band elements), and between the second-band arrays, respectively, of a conventional multi-band antenna. As best seen in FIG. 2, a spike occurs around the operating frequency of 1.7 GHz on the isolation curve of the two polarizations of the first high band array, the second high band array, and between the first and second high band arrays. This spike may represent a resonance on a high-band frequency, which may negatively affect antenna performance.

Aspects of the present disclosure may be directed to a first-band radiating element including an open-end trace for reducing, which may effectively remove a resonance on a second-band frequency, such as the aforementioned spike. Such an apparatus could be used in multi-band antennas to reduce the coupling between different frequency bands of operation.

Figure 4:
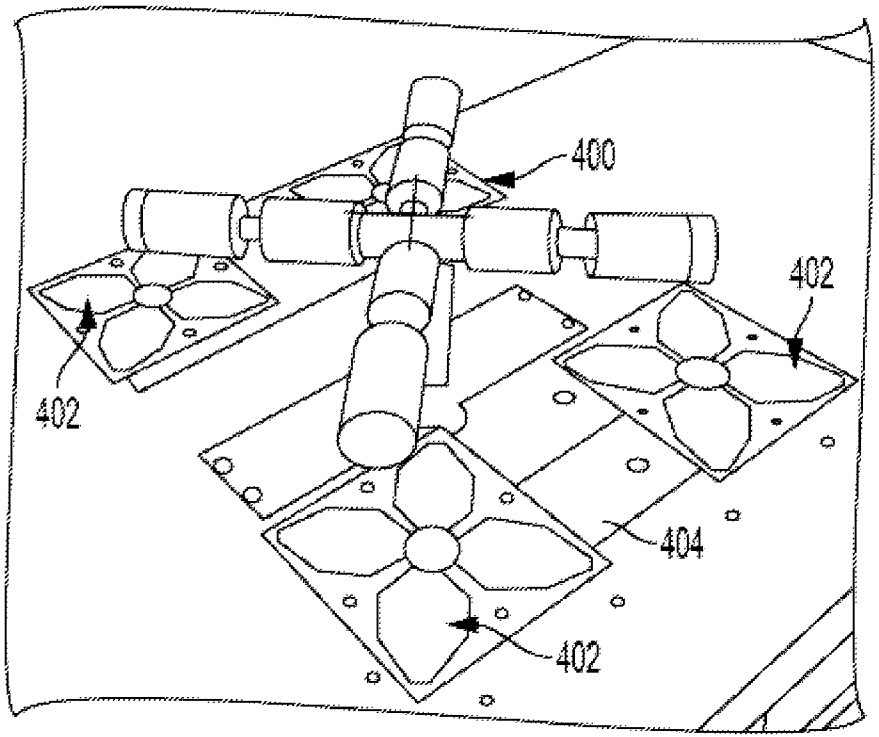
FIG. 4 is an illustration of a first-band radiating element among second-band radiating elements according to an aspect of the present disclosure.

FIG. 4 is a perspective view of a portion of a base station antenna with a radome removed. The portion shows a first-band radiating element 400 and a plurality of second-band radiating elements 402 mounted on a plane 404 of the base station antenna. The first-band radiating element 400 may be configured to operate in a low frequency band, and the plurality of second-band radiating elements 402 may be configured to operate in a high frequency band (e.g., a band of frequencies higher than the band of frequencies of the low band). For example, the high band may be within a frequency range of 1695-2700 MHz, and the low band may be within a frequency range of 698-960 MHz. As shown, the first-band and second-band radiating elements 400, 402 respectively, may take the form of crossed dipoles. The plane 404 may comprise a PCB substrate having opposing coplanar surfaces (i.e., a top surface and a bottom surface) upon which respective layers of copper cladding may be deposited. Please note that the illustration of the first-band radiating element 400 and second-band radiating elements 402 of FIG. 4 is by way of non-limiting example only, and that other configurations are contemplated. For example, there may exist any number of first-band radiating elements and second-band radiating elements in keeping with the spirit of the disclosure.

Figure 5:
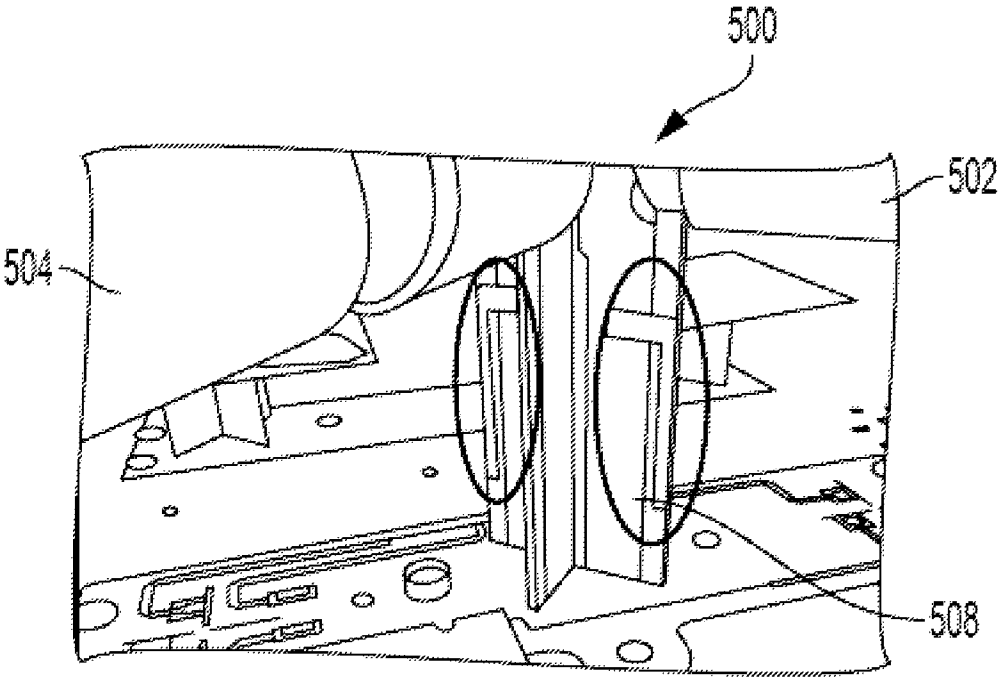
FIG. 5 is an enlarged view of a first-band radiating element according to an aspect of the present disclosure.

FIG. 5 is an enlarged view of a first-band radiating element 500 according to an aspect of the present disclosure. The first-band radiating element 500 may take the form of crossed balun-fed dipoles 502, 504. Each of the crossed balun-fed dipoles 502, 504 may include a vertical section ("stalk") PCB having a front side (not shown) and an opposing rear side 508 (e.g., ground side).

Figure 6:
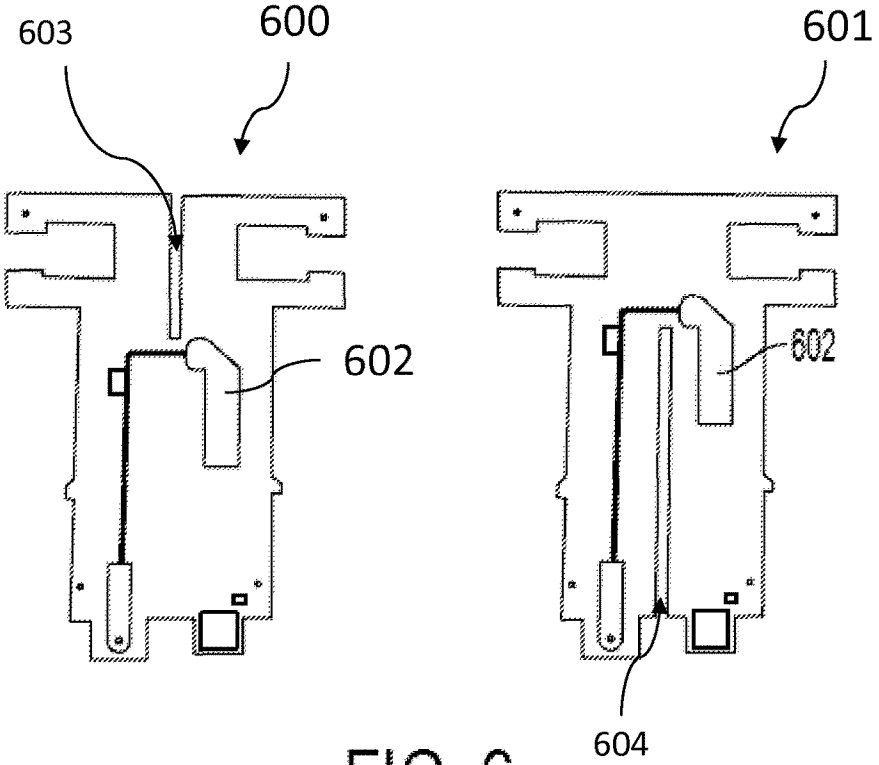
FIG. 6 is an illustration of a front side of a first-band printed circuit board (PCB) stalk according to an aspect of the present disclosure.

FIG. 6 is an illustration of surfaces of front sides of two PCB stalks 600, 601 of one of the balun-fed dipoles 502, 504. One of the two PCB stalks 600 may include a slot 603 that descends from the top of the PCB stalk 600. The other of the two PCB stalks 601 may include a slot 604 that extends upwardly from the bottom of the PCB stalk 601. The front side of each of the two PCB stalks 600, 601 may include a feed line 602, which may be connected to a feed network of a base station antenna.

Figure 7:
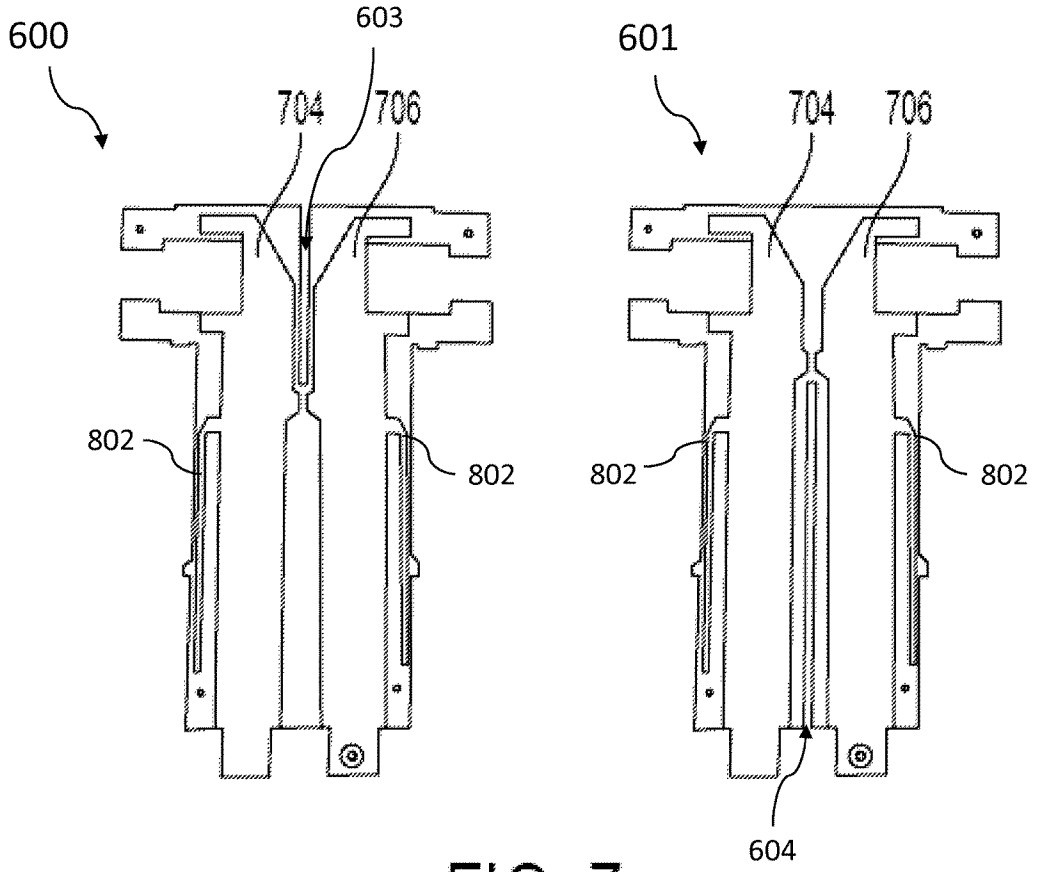
FIG. 7 is an illustration of a rear side of a first-band PCB stalk according to an aspect of the present disclosure.

As shown in FIG. 7, the opposing rear side (e.g., such as rear side 508) of one of the stalks 600, 601 may include a conductive layer comprising a pair of conductive planes 704, 706 electrically connected to the ground plane (not shown). For the first-band radiating element 500, the two PCB stalks 600, 601 may be coupled together such that the slot 603 may engage a top portion of the PCB stalk 601, and slot 604 may engage a bottom portion of the PCB stalk 600. The two PCB stalks 600, 601 may be arranged such that they bisect each other, and are at approximately right angles to each other. Each of the feed lines 602 may be capacitively coupled to the conductive planes 704, 706 which, when excited, may combine to provide the crossed balun-fed dipoles 502, 504. Connected to one or more of the two conductive planes 704, 706 are open-end traces 802, which are described in more detail in connection with FIG. 8.

Figure 8:
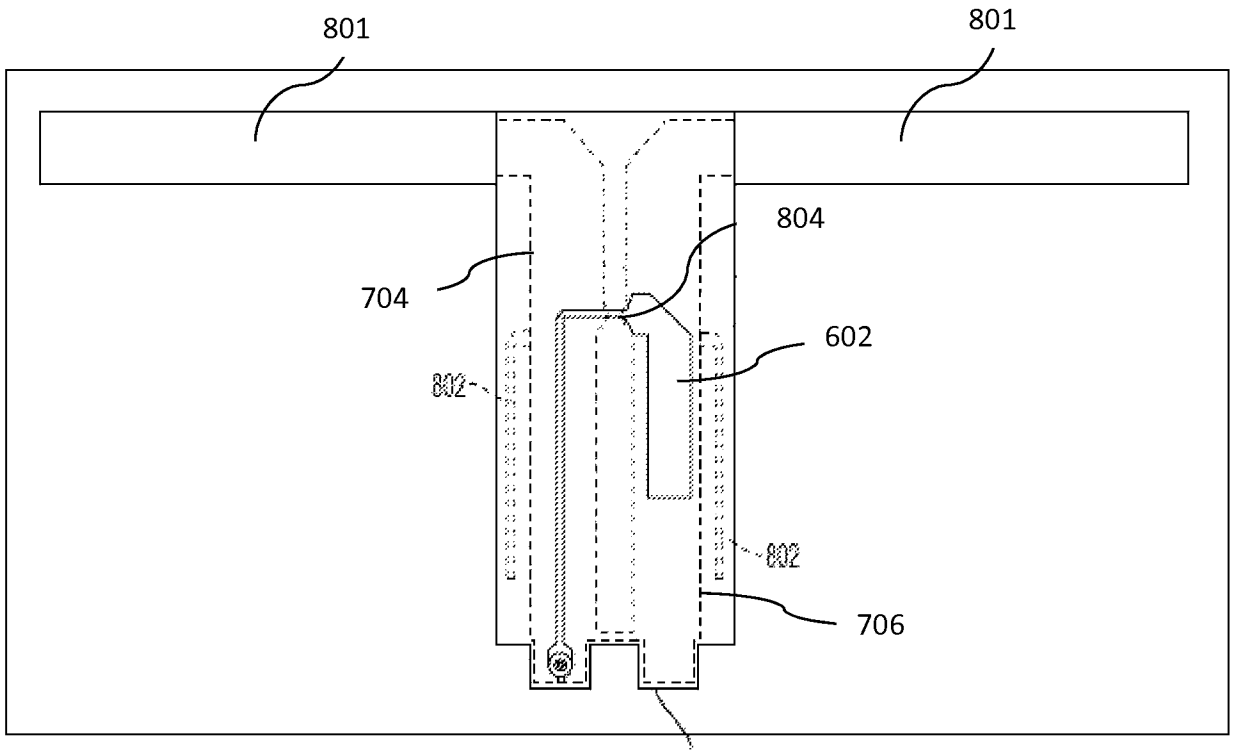
FIG. 8 is a schematic drawing of the rear side of a first-band PCB stalk according to an aspect of the present disclosure.

As best seen in the enlarged schematic of the rear side (shown in dashed lines) and front side (shown in solid lines) of the PCB stalk 600 in FIG. 8, the rear side may include open-end traces 802, each of which may be connected to one of the two conductive planes 704, 706. Dipole arms 801 may be attached to respective ends of the PCB 600. Each of the open-end traces 802 may act as a second-band shorting point between two first-band PCB stalks to reduce second-band energy flow on the first-band PCB stalk, which may help reduce or eliminate the second-band resonance. The location of each of the open-end traces 802 in relation to the two conductive planes 704, 706 may vary, but may be slightly lower than a balun crossing point 804 (e.g., the height on the stalk at which the input trace of the front side may cross over the conductive lines of the rear side). Such a position of the open-end traces 802 may result in minimal impact to first-band performance. According to aspects discussed herein, each of the open-end traces may preferably have a length of ¼ wavelength to a second-band frequency signal of the multi-band antenna in which it is implemented. However, each of the open-end traces may be other lengths, as well, in keeping with the spirit of the disclosure. Also, the height of each of the stalk PCBs discussed herein may be of varying lengths, as known in the art.

Figure 9:
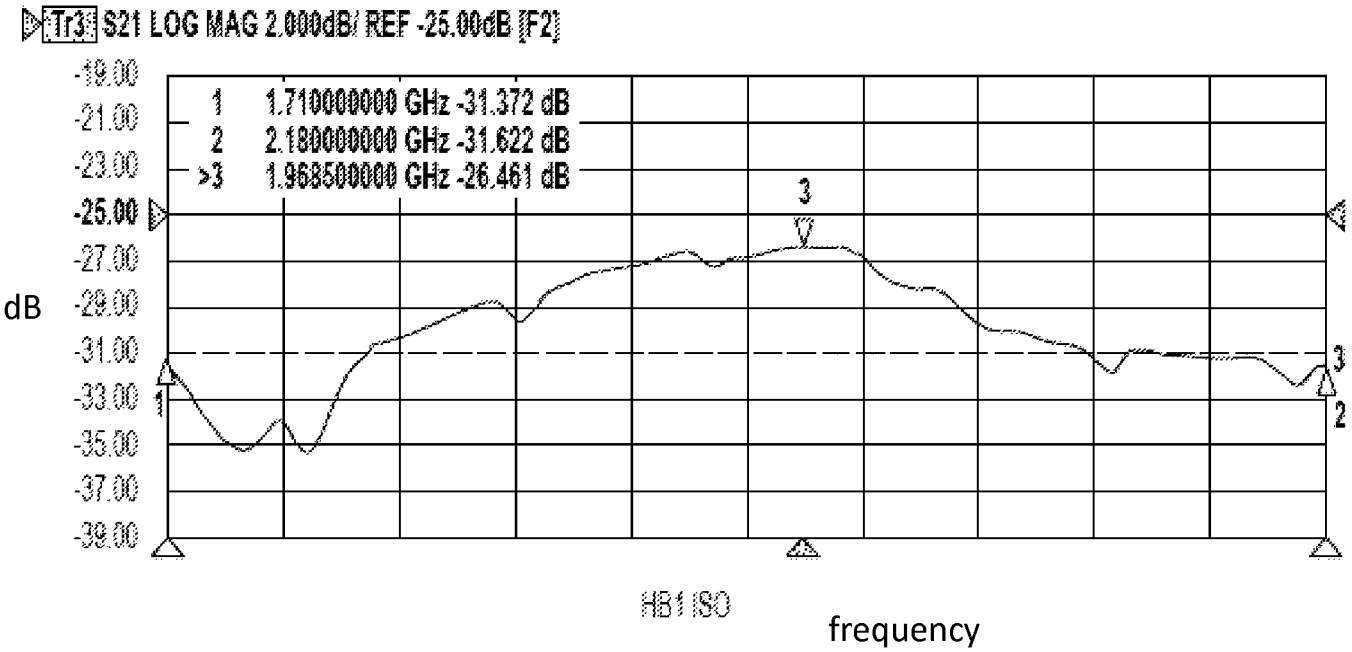
FIG. 9 is an isolation curve of two polarizations of one array of second-band radiating elements in an antenna employing open-end traces on one or more first-band radiating elements according to an aspect of the present disclosure.
Figure 10:
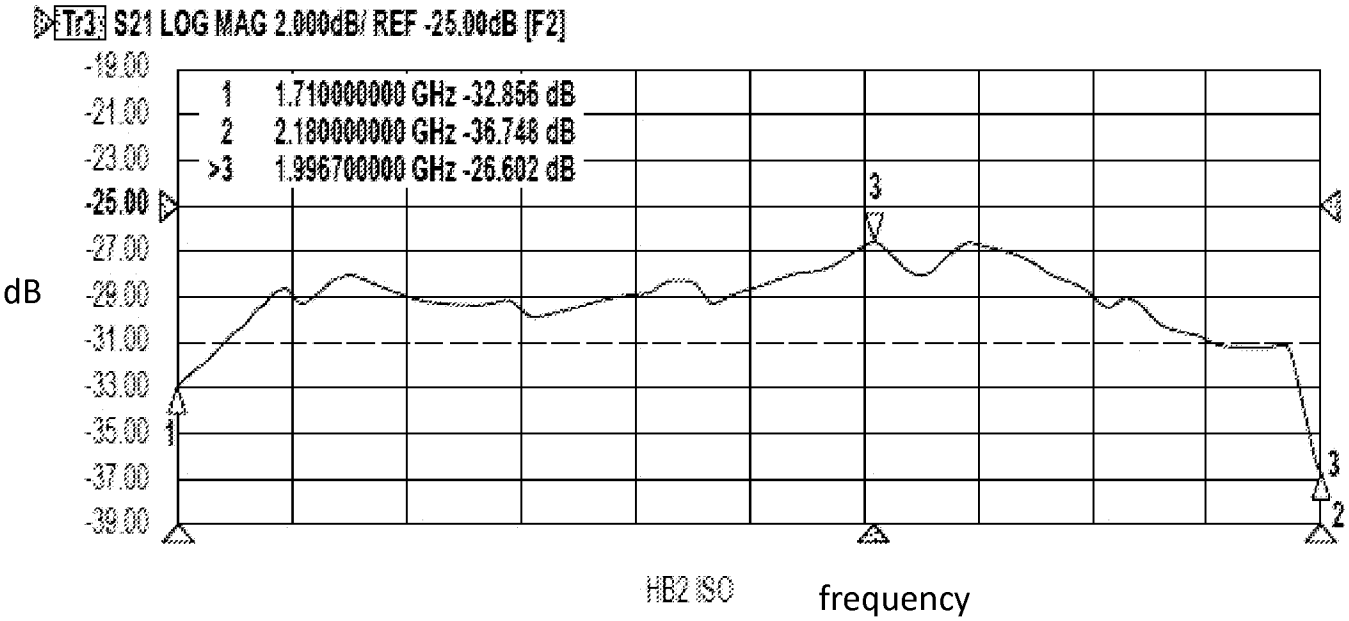
FIG. 10 is an isolation curve of another array of second-band radiating elements in the antenna employing open-end traces on one or more first-band radiating elements, according to an aspect of the present disclosure.
Figure 11:
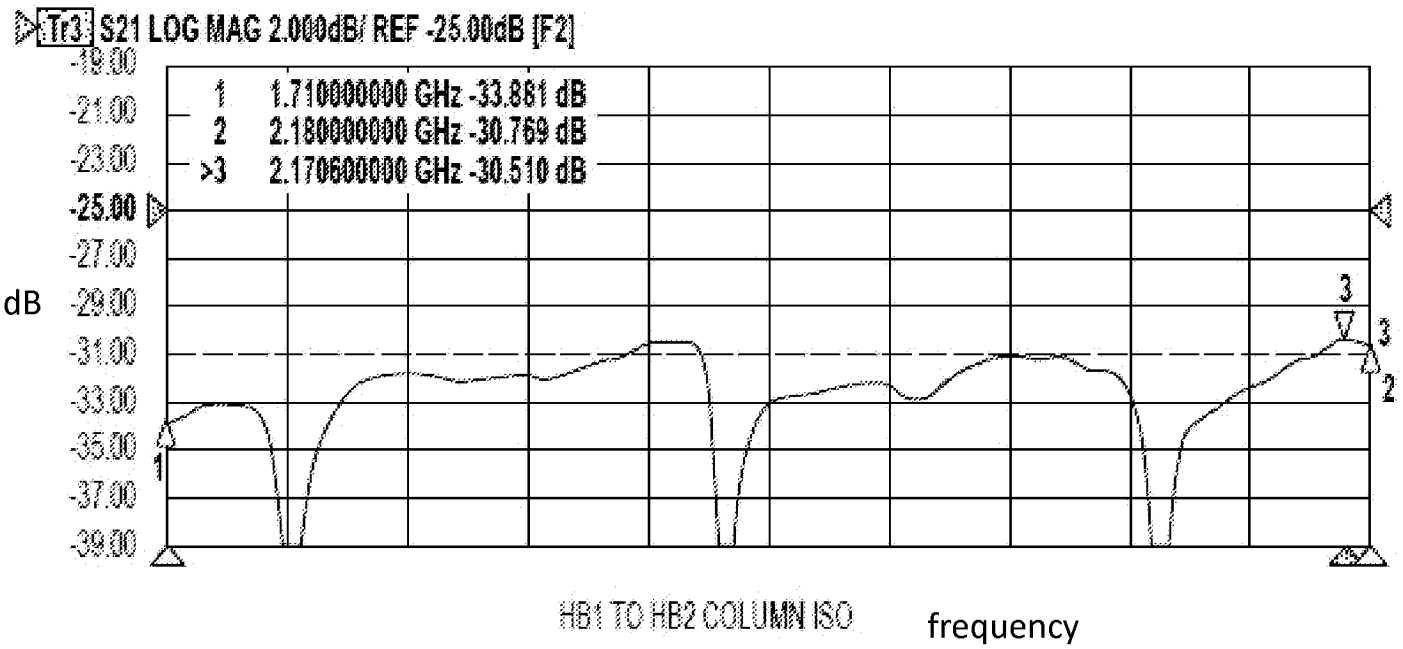
FIG. 11 is an isolation curve between arrays of second-band radiating elements, according to an aspect of the present disclosure.

FIGS. 9, 10, and 11 are isolation curves of two polarizations of a first high-band array, a second high-band array, and between the first and second high-band arrays, respectively, employing the above discussed open-ended traces according to aspects of the disclosure. As shown, there no longer exists a spike around the operating frequency of 1.7 GHz on the isolation curve of the two polarizations of the second high band array, and between the first and second high-band arrays.

As such, discussed herein thoughout, aspects of the present disclosure may serve to alleviate problems with resonance from low band dipole radiating elements creating interference with high band frequencies, without significant, if any, impact to the performance of the low band antenna elements themselves.

Various aspects of the disclosure have now been discussed in detail; however, the invention should not be understood as being limited to these aspects. It should also be appreciated that various modifications, adaptations, and alternative embodiments thereof may be made within the scope and spirit of the present invention.

What is claimed is:

1. A first-band radiating element configured to operate in a first frequency band, the first-band radiating element comprising:

a first printed circuit board including:

a first surface including a first feed line connected to a feed network of a feed board of an antenna;

a second surface opposite the first surface, the second surface including:

one or more first conductive planes connected to a ground plane of the feed board; and one or more first open-end traces coupled to the one or more first conductive planes.

2. The first-band radiating element of claim 1, wherein the first-band radiating element is positioned spatially between two sub-arrays of second-band radiating elements, wherein each of the second-band radiating elements is configured to operate in a second frequency band.

3. The first-band radiating element of claim 2, wherein each of the one or more first open-end traces has a length that is a quarter wavelength of a wavelength corresponding to the second frequency band.

4. The first-band radiating element of claim 1, wherein the one or more first conductive planes comprise:

two first conductive planes positioned on opposite sides of a central longitudinal axis of the first printed circuit board.

5. The first-band radiating element of claim 4, wherein the one or more first open-end traces comprise two open-end traces coupled to the two first conductive planes, respectively.

6. The first-band radiating element of claim 4, wherein the one or more first open-end traces are positioned below a crossing point of the first feed line.

7. The first-band radiating element of claim 1, further comprising:

a second printed circuit board connected to the first printed circuit board, the second printed circuit board including:

a third surface including a second feed line connected to the feed network;

a fourth surface opposite the third surface, the fourth surface including:

a second conductive plane connected to the ground plane of the feed board; and at least one second open-end trace coupled to the second conductive plane.

8. A crossed dipole radiating element comprising:

a first-band radiating element configured to operate in a first frequency band, the first-hand radiating element comprising:

a first printed circuit board including:

a first surface including a first feed line connected to a feed network of a feed board of an antenna;

a second surface opposite the first surface, the second surface including:

one or more first conductive planes connected to a ground plane of the feed board; and one or more first open-end traces coupled to the one or more conductive planes; and a longitudinal slot along a central longitudinal axis of the first printed circuit board;

a second printed circuit board slidably engaged in the longitudinal slot of the first printed circuit board.

9. The crossed dipole radiating element of claim 8, wherein the second printed circuit board includes:

a third surface including a second feed line connected to the feed network;

a fourth surface opposite the third surface, the fourth surface including:

a second conductive plane connected to the ground plane of the feed board; and at least one second open-end trace coupled to the conductive plane.

10. The crossed dipole radiating element of claim 8, wherein the first-band radiating element is positioned spatially between two sub-arrays of second-band radiating elements, wherein each of the second-band radiating elements is configured to operate in a second frequency band.

11. The crossed dipole radiating element of claim 8, wherein each of the one or more first open-end traces has a length that is a quarter wavelength of a wavelength corresponding the second frequency band.

12. The crossed dipole radiating element of claim 8, wherein the one or more first conductive planes comprise:

two first conductive planes positioned on opposite sides of a central longitudinal axis of the printed circuit board.

13. The crossed dipole radiating element of claim 12, wherein the one or more first open-end traces comprise two open-end traces being coupled to the respective two first conductive planes.

14. The first-band radiating element of claim 1, wherein the first surface of the printed circuit board further includes a balun.

15. The first-band radiating element of claim 14, wherein a first of the open-end traces is below a crossing point of the balun where the first feed line crosses over the one or more first conductive planes.

16. The first-band radiating element of claim 1, further comprising a first dipole arm connected to the printed circuit board and a second dipole arm connected to the printed circuit board.

17. A first-band radiating element configured to operate in a first frequency band, the first-band radiating element comprising:

a feed stalk including a first printed circuit board and a second printed circuit board, the first printed circuit board including a first surface that has a first feed line thereon that is connected to a first feed network of an antenna and a second surface opposite the first surface, the second surface including a first conductive plane connected to a ground plane and a first open-end trace that is coupled to the first conductive plane, the second printed circuit board including a third surface that has a second feed line thereon that is connected to a second feed network of the antenna and a fourth surface opposite the third surface, the fourth surface including a second conductive plane connected to the ground plane and a second open-end trace that is coupled to the second conductive plane, the second printed circuit board slidably engaged in a longitudinal slot of the first printed circuit board.

18. The first-band radiating element of claim 17, wherein the first-band radiating element is positioned spatially between two sub-arrays of second-band radiating elements, wherein each of the second-band radiating elements is configured to operate in a second frequency band.

19. The first-band radiating element of claim 18, wherein each of the first and second open-end traces are configured to act as a second-band shorting point to reduce energy in the second frequency band which flows on the first and second printed circuit boards.

20. The first-band radiating element of claim 18, further comprising a first dipole arm connected to the first printed circuit board and a second dipole arm connected to the second printed circuit board.

* * * * *